US006817048B1

(12) United States Patent
LaRosa

(10) Patent No.: US 6,817,048 B1
(45) Date of Patent: Nov. 16, 2004

(54) INFANT SLEEP POUCH

(76) Inventor: Penilopee Lee LaRosa, P.O. Box 701842, Tulsa, OK (US) 74170-1842

( * ) Notice: Subject to any disclaimer, the term of this patent is extended or adjusted under 35 U.S.C. 154(b) by 0 days.

(21) Appl. No.: 10/323,116

(22) Filed: Dec. 18, 2002

Related U.S. Application Data

(60) Provisional application No. 60/344,814, filed on Jan. 7, 2002, and provisional application No. 60/351,272, filed on Jan. 25, 2002.

(51) Int. Cl.[7] ..... A47G 9/04; A47D 15/00; A41B 13/06

(52) U.S. Cl. ..... 5/494; 5/655; 5/923; 5/483; 2/69.5; 128/873

(58) Field of Search ..... 5/494, 482, 483, 5/424, 655, 922, 923, 954; 2/69, 69.5; 128/872, 873, 874, 875

(56) References Cited

U.S. PATENT DOCUMENTS

| | | | | | |
|---|---|---|---|---|---|
| 1,048,033 | A | * | 12/1912 | Brown | 128/875 |
| 1,502,276 | A | * | 7/1924 | Siebert | 128/875 |
| 1,639,424 | A | * | 8/1927 | Breslin | 128/875 |
| 2,034,954 | A | * | 3/1936 | Murphy | 128/874 |
| 2,102,281 | A | * | 12/1937 | Pringle | 128/875 |
| 2,225,884 | A | * | 12/1940 | Parks | 128/873 |
| 2,404,935 | A | * | 7/1946 | Weisel | 128/873 |
| 2,423,392 | A | * | 7/1947 | Krogh | 128/873 |
| 2,439,658 | A | * | 4/1948 | Holloway | 128/873 |
| 2,521,175 | A | * | 9/1950 | Kruse | 128/874 |
| 2,693,177 | A | * | 11/1954 | Barstow | 128/874 |
| 2,758,595 | A | * | 8/1956 | Lovett | 5/655 |
| 2,863,450 | A | * | 12/1958 | Johnson | 128/874 |
| 2,940,443 | A | * | 6/1960 | Baker | 128/874 |
| 3,536,067 | A | * | 10/1970 | Sternagel | 128/873 |
| 4,026,282 | A | * | 5/1977 | Thomas | 128/873 |
| 4,802,244 | A | * | 2/1989 | McGrath-Saleh | 2/69 |
| 4,858,625 | A | * | 8/1989 | Cramer | 128/872 |
| 4,862,535 | A | * | 9/1989 | Roberts | 5/655 |
| 4,883,701 | A | * | 11/1989 | Rankin et al. | 428/136 |
| 4,886,697 | A | * | 12/1989 | Perdelwitz et al. | 428/192 |
| 4,891,454 | A | * | 1/1990 | Perdelwitz et al. | 428/137 |
| 4,989,286 | A | * | 2/1991 | Tucker | 5/482 |
| 5,208,925 | A | * | 5/1993 | Edlund | 5/424 |
| 5,232,267 | A | * | 8/1993 | DeMatteo et al. | 297/467 |
| 5,331,699 | A | | 7/1994 | Patton et al. | 5/655 |
| 5,333,623 | A | * | 8/1994 | Fuller | 128/875 |
| 5,347,669 | A | | 9/1994 | Neviaser et al. | 5/655 |
| RE34,763 | E | * | 10/1994 | Tucker | 5/482 |
| 5,400,803 | A | * | 3/1995 | Vines | 128/872 |
| 5,416,938 | A | * | 5/1995 | Li | 5/494 |
| 5,439,008 | A | * | 8/1995 | Bowman | 128/875 |
| 5,494,052 | A | * | 2/1996 | Grohman | 128/873 |
| 5,499,418 | A | | 3/1996 | Tan et al. | 5/655 |
| 5,579,552 | A | * | 12/1996 | Henry | 5/655 |
| 5,746,219 | A | | 5/1998 | McConnell | 128/845 |
| 5,890,769 | A | * | 4/1999 | Fairbanks | 297/467 |
| 6,381,785 | B1 | * | 5/2002 | Mancera Browne et al. | 5/655 |
| 6,681,422 | B2 | * | 1/2004 | Landry | 5/494 |
| 6,708,356 | B1 | * | 3/2004 | LaValle | 5/655 |
| 2002/0108176 | A1 | * | 8/2002 | Ragen | 5/482 |
| 2003/0154549 | A1 | * | 8/2003 | Landry | 5/494 |
| 2004/0019970 | A1 | * | 2/2004 | Landry | 5/494 |

OTHER PUBLICATIONS

Gershman, Maurice, M.D. "Self–Adhering Nylon Tapes." Journal of A.M.A. (vol. 168, No. 7) Oct. 18, 1958.*

* cited by examiner

*Primary Examiner*—Robert G. Santos
(74) *Attorney, Agent, or Firm*—Head, Johnson and Kachigian

(57) ABSTRACT

A device and method for restraining the movement of an infant within a crib significantly reduces the risk of accidental injury or death of a child. An infant is placed within the sleeping pouch which is then attached to the mattress or a cover on the mattress. The device allows an infant to lie on it's back and roll from side to side. The device and method prevents an infant from rolling over on its stomach and from placing limbs between crib rail slots and between the crib frame and the mattress.

11 Claims, 4 Drawing Sheets

INFANT SLEEP POUCH

CROSS REFERENCE TO RELATED APPLICATIONS

This application is based on U.S. Provisional Patent Application No. 60/344,814 entitled SLEEP SAFE BABY COZY filed Jan. 7, 2002 and U.S. Provisional Patent Application No. 60/351,272 entitled SLEEP SAFE BABY COZY filed Jan. 25, 2002.

BACKGROUND OF THE INVENTION

1. Field of the Invention

The present invention relates to a pouch that is attached to a mattress covering within a child's crib. The baby is inserted into the pouch and the pouch's movement is restricted by its attachment to the mattress. The pouch prevents an infant from rolling onto it's stomach or becoming lodged between the bars of the crib while still allowing the baby to roll from side to side. The constriction of the infant's movement by the pouch protects the infant from Sudden Infant Death Syndrome and other dangers.

2. Prior Art

For centuries, cribs have been used in place of standard beds to provide a sleeping area for babies and infants. The railings on these devices prevent infants from rolling off their mattress and injuring themselves. Unfortunately, cribs do not protect infants from all dangers.

Sudden Infant Death Syndrome (SIDS) causes the deaths of thousands of children in this country alone. SIDS is usually caused by infants rolling over into a face-down position and suffocating. Children may also be suffocated by bumpers and blankets in their cribs. The infant may accidentally suffocate itself as it is unable to roll back over. To prevent this, it is known to place pillows or other semi-firm devices on either side of an infant while they are laying on their backs. Placing these devices on either side of the infant prevents him or her from rolling over and suffocating. However, this method greatly restricts the infant's movement and does not allow an infant to roll onto his or her sides. This results in a lack of comfort for the infant. In addition, larger infants may accidentally push such support devices away from them such that they may roll over.

Another danger encountered by infants within a crib is the railing of the crib itself. Infants may inadvertently get one or more limbs caught in slots between rails and/or between the mattress and the frame of the crib. This may result in skin bruises and abrasions as well as the twisting and spraining of joints.

There therefore exists a need to provide a safe but comfortable and effective method of restraining the movement of a child within a crib.

It is also desirable to provide a method for effectively preventing an infant from projecting its arms and legs through the slots between rails of the crib.

It is also desirable to provide an effective method for reducing the risk of Sudden Infant Death Syndrome.

SUMMARY OF THE INVENTION

The present invention consists of a pouch into which a baby is placed. A zipper and flaps having Velcro® pads are used to enclose a substantial portion of the child's upper body within the pouch. Shoulder straps hold the child in place while allowing his or her head and arms to protrude from the pouch and move freely. The back of the pouch is pivotally attached to a half sheet mattress cover such that the baby may lay on its back or roll from side to side. Velcro® is preferably used to attach the pouch to the half sheet, as it is safe and strong. The invention eliminates the need of a blanket and prevents movement to the edge of a mattress where a child could suffocate against a bumper or blanket.

The shoulder straps have Velcro® pads on their distal ends. These distal ends are placed between flaps on the chest of the pouch also having Velcro® pads. This securely holds the shoulder straps in place so that the infant fits snuggly within the pouch and straps such that it may not come out of the sleep pouch. The tight, secure attachment of the shoulder straps prevents the child from removing them. Because the shoulder straps attach to Velcro® pads between pouch flaps, they may be adjusted to comfortably fit the child as it grows. This allows the same sleep pouch to be used from the birth of a child until the time that it no longer sleeps within a crib.

Those skilled in the art will appreciate that there are a wide variety of government regulations on clothing and bedding materials for infants. These regulations are designed to minimize health risks to children. For example, children's sleepwear must be made of fire resistant material. There are also restrictions on the type of connecting and attaching means used. The present invention is readily adaptable to the regulations and well suited for use in government approved methods.

Because the child may not roll over such that he or she lies face down on the mattress, the risk of SIDS is minimized. Furthermore, because the child is restricted to the center of the mattress, the child cannot suffocate on the bumper or get arms or legs stuck or damaged between the rails of the crib or between the frame and the mattress. They are prevented from being suffocated by the blanket. The sleep pouch of the present invention also allows a child to freely move his or her head and arms. The lower portion of the pouch is larger than the torso portion and allows a child to move and kick his or her legs freely within the pouch.

The sleep pouch of the present invention may be comprised of a thin, lightweight material such that the child does not become overly hot while sleeping in it. Alternatively, the sleep pouch may be comprised of a thick, warm material to enhance comfort in relatively cold environments.

It is therefore an object of the present invention to provide a method and apparatus to enhance the safety of a child while laying or sleeping.

DETAILED DESCRIPTION OF THE PREFERRED EMBODIMENTS

Figure 1:
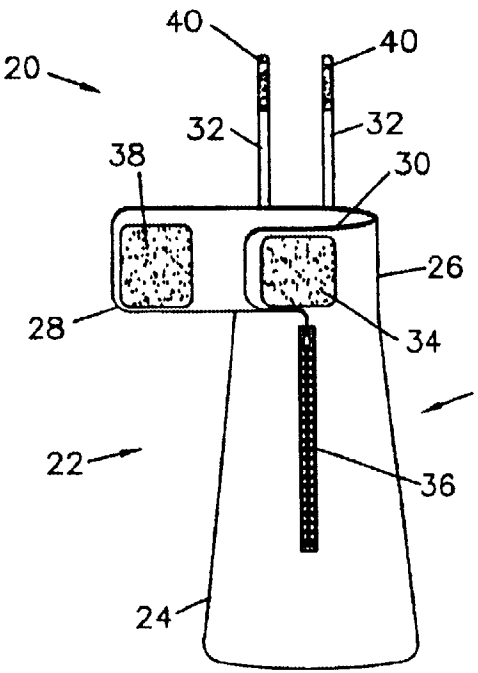
FIG. 1 is a front diagrammatic view of the invention.

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

The present invention provides a safety pouch that prevents a child from rolling onto its stomach. An added advantage of the present invention is that, when used in a crib, it prevents a child from entangling his or her arms in various structural features of the crib. In the preferred embodiment, the invention comprises a pouch into which a child may be securely fastened. The front of the pouch has a zipper that allows the pouch to be opened so that a child may be easily placed in it. At the top of the pouch are two flaps having Velcro® pads on them so that they may be attached to one another. The region of the pouch that is opened by means of the zipper is relatively large. This allows the child to kick its legs about freely and also allows the pouch to continue fitting the child as he or she grows. Both the chest and shoulder straps are adjustable.

The attachable shoulder straps at the top are designed to hold the child in the pouch securely. The flaps fold over the torso portion of the child. Because the flaps enclose the child by means of Velcro®, how loosely or tightly the flaps fold over the child may be adjusted to accommodate the child as he or she grows. The chest flaps generally begin approximately where the zipper ends.

Two shoulder straps are sewn to the top back of the pouch. Alternatively, the shoulder straps may be formed from the same material of which the pouch is comprised. This reduces the amount of stitching necessary. The shoulder straps are long and thin. At their ends, they have Velcro® pads on at least one side of them. The shoulder straps may have Velcro® pads on both sides and these ends are placed between the flaps on the front of the pouch. Shoulder straps go over the shoulder of the child. Because Velcro® is used, they may be adjusted as the child grows. In addition, having Velcro® inserted between the flaps on the front of the pouch provide very secure attachments and insure that the child will not come out of the pouch.

One of the key, novel features of the invention is the pivoting device located on the back of the pouch. Although a pouch may simply be attached to a mattress by means of a Velcro® pad on the back of the pouch corresponding to a Velcro® pad attached to the mattress, this allows very little movement. The child is essentially restricted to laying in the face up position. The present invention, however, discloses connection panels that connect the back of the pouch to the Velcro® connecting pad. These connection panels are a couple of inches wide. This distance created between the connecting pad and the back of the pouch allows a child to easily pivot so that he or she lays on his or her side or back. This greatly enhances the comfort for the child. Preferably, two connection panels are used. This is generally preferred as it keeps manufacturing costs low. However, one connection panel may also be used. Those skilled in the art will appreciate that the physics of pulling on a single connection panel connected to the center of a connecting pad provides for a stronger connection and makes the pouch more difficult to remove. While this offers the advantage of strength over the two connection panel system, it also results in a connection panel that is more likely to tear or tear off of the pouch.

Child mattresses generally do not have Velcro® pads already on them. In order to avoid costs to the consumer of replacing an entire mattress, the present invention provides a mattress cover having a connection pad on it. This mattress cover may cover the entire mattress or only a small portion of it. It may be connected to the mattress by a variety of methods. Preferably, a series of laces or ropes on the edges of the mattress cover may be tied to the frame of the crib in which the mattress lies. However, those skilled in the art will appreciate that the present invention will work outside of a crib. Therefore, it may be desirable to provide laces or other attachment means that go all the way around the mattress and connect to one another on the underside of the mattress. This allows the present invention to be practiced on mattresses that are not in cribs. This is especially advantageous when a child is on a trip and away from home. The present invention effectively eliminates the need for portable cribs.

Figure 11:
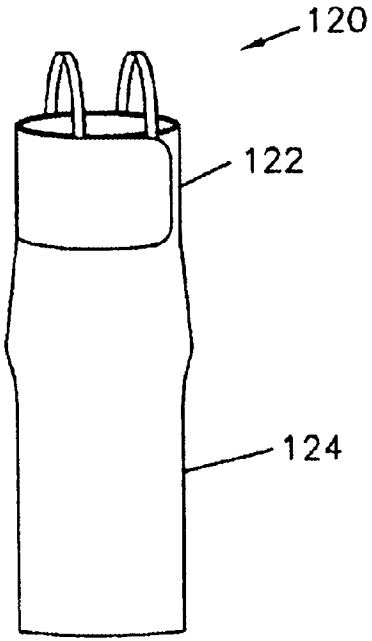
FIG. 11 is a diagrammatic front view of an alternative embodiment of the present invention.

FIGS. 1 through 4 show the preferred embodiment of the present invention. Referring to FIG. 1, safety pouch 20 is comprised of a pouch 22. Pouch 22 has a-leg portion 24 and a torso portion 26. As shown in this embodiment, it is preferred that leg portion 24 has a relatively larger volume than torso portion 26. This allows the child to freely move and kick his or her legs. Although leg portion 24 may be formed in roughly the same size as torso portion 26 (as shown in FIG. 11 below), this is generally not preferred as it reduces the amount of comfort for the child. Zipper 36 runs along the front of the leg portion 24 up to torso portion 26. Zipper 36 allows the pouch to be opened up such that a child may easily be placed within the pouch. The absence of zipper 36 is possible, but makes enclosing the child within the pouch considerably more difficult, especially if the child is particularly rambunctious. Primary flap 26 begins approximately where zipper 36 ends. Flap 26 folds over substantially all of the chest or torso region of the child. Flap 26 may be shortened such that it covers a small portion of the child's body. However, this is generally not preferred. Those skilled in the art will appreciate that the more surface area over which the flaps are in contact, the tighter the fastening and more secure the child. Flap 26 has connecting pad 34. Connecting pad 34 is preferably a hook and loop device such as Velcro®. However, those skilled in the art will appreciate that there are other similar methods for attaching the flaps.

On the opposite side of the pouch from flap 26 is secondary flap 28. Like primary flap 26, secondary flap 28 has a connection pad 38 that allows flap 26 to connect to flap 28 by means of their connection pads. As stated above, it is generally preferred to use Velcro® or a similar hook and loop mechanism. This is preferred because Velcro® is a very safe connecting material and may not harm the child. The use of buttons, snaps or laces is generally not preferred because buttons may fall off and choke the child,snaps are hard and they injure the child and laces may wrap around a child's neck or limbs causing circulation to be cut off or even suffocation.

Shoulder straps 32 are attached to the rear of pouch 22 and have connecting pads 40 at their ends. Because FIG. 1 is a front view of the preferred embodiment, it cannot be seen that there are similar connecting pads opposite of pads 40 on the ends of straps 32. The ends of shoulder straps 32 are inserted in between connection pads 34 and 38 such that shoulder strap connection pads 40 and the pads opposite them attach to both pads 34 and 38. This strengthens the attachment of shoulder straps 32 and ensures that a child is securely fashioned within the pouch.

As can be understood when considering the drawings, the pouch is first unzipped. The child is then placed within the pouch such that he faces the front of the pouch, the same size of the pouch on which the zipper and flaps are. Once the child is inserted within the pouch, the zipper is zipped. Next, primary flap 26 is folded over the child's torso. Next, shoulder straps 32 are folded over the child's shoulders such that the arms and head of the child protrude from pouch 22. Shoulder straps 32, because they are attached by Velcro® means, may be adjusted so that the child is comfortably but securely enclosed within the pouch. After shoulder straps 32 have been folded over the shoulders and connection straps 40 have been connected to connection pad 34, secondary flap 28 is folded over primary flap 26 such that connection pad 38 engages connection pad 34 as well as connection pads on the sides of shoulder straps 32 opposite connection pads 40.

Figure 2:
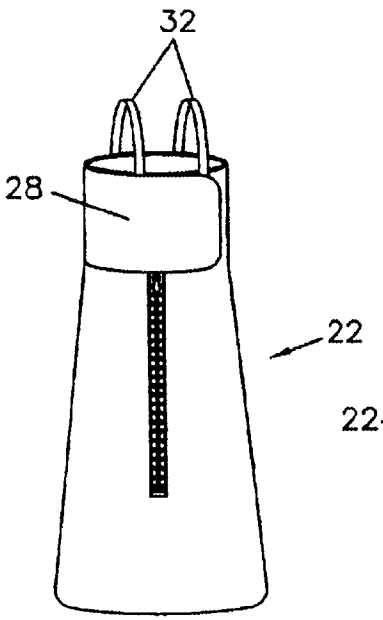
FIG. 2 is a front diagrammatic view of the invention in a different configuration.

This closed formation of the pouch may be readily seen in FIG. 2. When flap 28 is folded over flap 26, shoulder straps 32 are securely locked into place such that the child's head fits between the shoulder straps and each of his or her arms fits between a shoulder strap and pouch 22.

Figure 3:
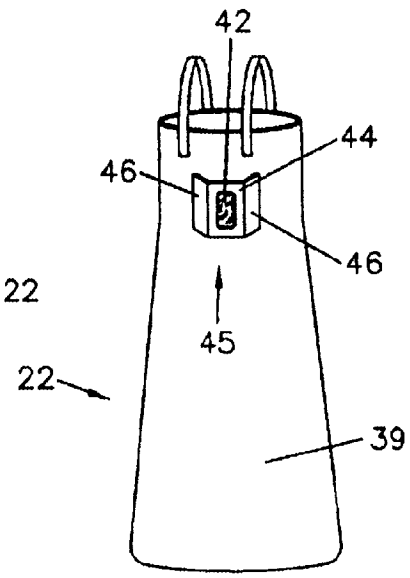
FIG. 3 is a rear diagrammatic view of the invention.

FIG. 3 shows the back side of pouch 22. In FIG. 3, the pivoting device 45 and connecting pad 44 may be readily seen. The pivoting device 45 is comprised of two connection panels 46 that connect the back 39 of pouch 22 to connecting pad 44. Connecting pad 44 has a Velcro® pad. 42 on the outwardly facing side of it. Pad 42 allows connecting pad 44 to securely attach to a connecting pad on a mattress as described below. Connection panels 46 are sufficiently long to allow a child to comfortably roll over onto his or her side. However, connection pads 46 must be short enough to prevent a child from rolling all the way over onto his or her stomach. Overly long connection panels 46 would defeat the purpose of the present invention.

Figure 4:
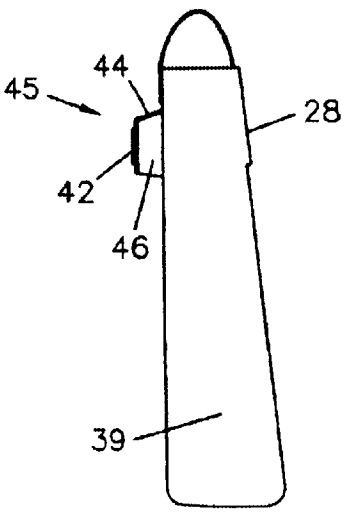
FIG. 4 is a side diagrammatic view of the invention.

In FIG. 4 it can be seen how the pivoting device 45 protrudes outwardly from the rear 39 of the pouch. It is this distance and the flexibility of connection panels 46 that facilitate a child's pivoting action in rolling from side to side.

Figure 6:
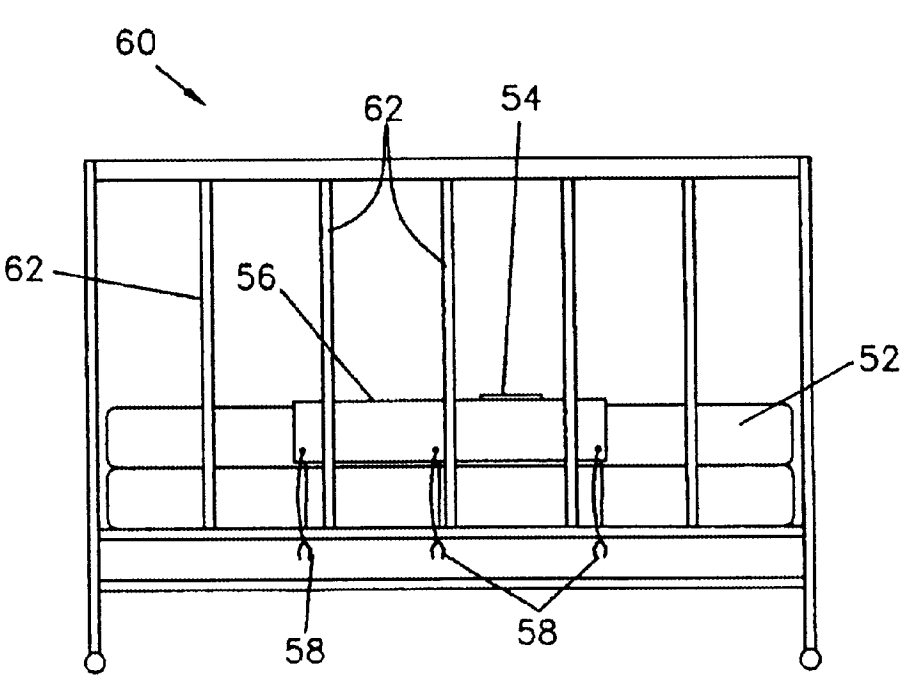
FIG. 6 is a diagrammatic side view of a part of the invention.
Figure 5:
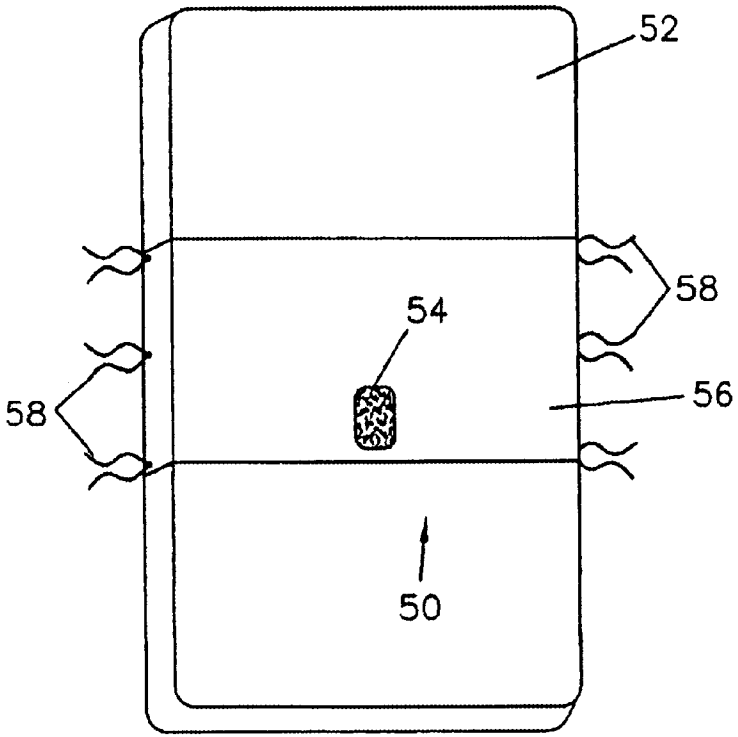
FIG. 5 is a diagrammatic top plan view of a part of the invention.

FIGS. 5 and 6 illustrate one preferred method of attaching a connection pad to a mattress. Referring to FIG. 5, mattress cover 50 is placed on top of mattress 52. In this particular embodiment, mattress cover 50 only covers a portion of the mattress. As explained above, mattress cover 50 may cover the entire mattress or only a portion of it. Connecting pad 54 is sewn into the top cover 56 and is comprised of Velcro®, such that it corresponds to connecting pad 44 and its Velcro® pad 42. In this particular embodiment, mattress cover 50 is connected to the frame of a crib by means of laces 58. This can be seen in FIG. 6. Crib 60 has a series of rails 62. Laces 58 may be used to tie the mattress cover to these rails or to other portions of the frame structure of crib 60. It is generally preferred to have connecting pad 54 at or near the center of mattress cover 50 and for it to be positioned to where it is at or near the center of mattress 52. This results in the baby's movement being restricted such that it cannot come in contact with rails 62 or other portions of the crib 60 framework. This prevents the child from becoming lodged between rails 62 or other portions of the crib 60 framework.

FIGS. 7 through 11 show a variety of modifications and alternative embodiments. FIGS. 1 through 6 generally show the preferred embodiment. However, the modifications listed below are all suitable. However, those skilled in the art will appreciate that FIGS. 7 through 11 illustrate only a few of many modifications within the scope of the present invention that do not form substantial distinctions between them and this disclosure.

Figure 7:
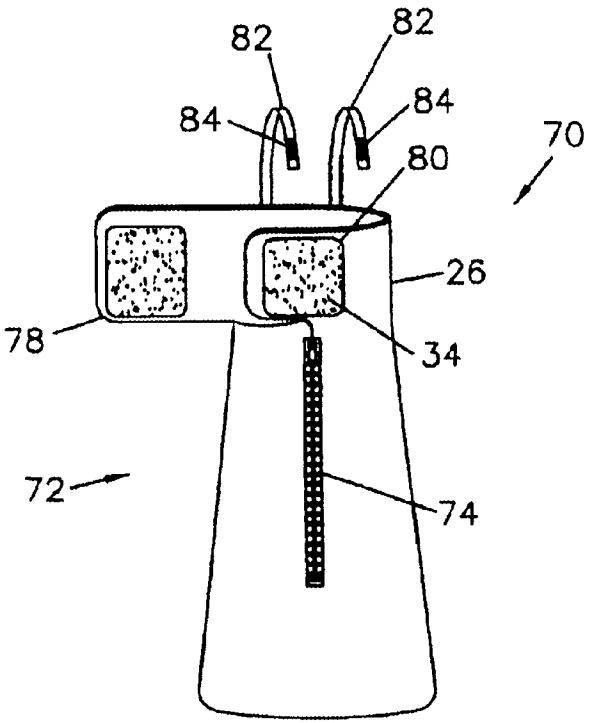
FIG. 7 is a diagrammatic front view of an alternative embodiment of the present invention.

In FIG. 7, safety pouch 70 is comprised of pouch 72. Pouch 72, as the previously described embodiment, has a zipper 74 and flaps 80 and 78. In this figure, shoulder straps 82 are folded over such that connecting pads 84 may be seen. As with the embodiment described in FIG. 1, connecting pads 84 have corresponding connecting pads opposite them on the sides of shoulder straps 82 not shown. FIG. 7 also shows pouch 72 having a more rounded or bulbous design. The previously disclosed embodiment had a more "squared off" design having corners at the bottoms of the leg portions. In some cases, the bulbous shape of pouch 72 may be considered more aesthetically pleasing. However, the general shape of the pouch does not have a significant impact on the overall utility of the present invention. Those skilled in the art will appreciate that various spherical and parallelepiped geometries are suitable for the present invention.

Figure 8:
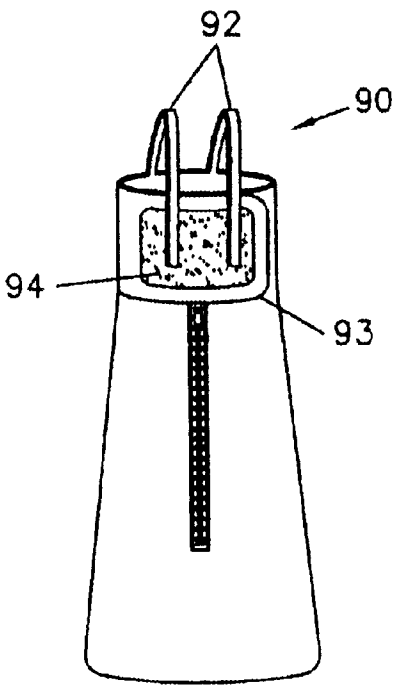
FIG. 8 is a diagrammatic front view of an alternative embodiment of the present invention.

FIG. 8 shows an alternative method for attaching shoulder straps to the front of the pouch. In this embodiment, secondary flap 93 has a second connection pad 94 on the outside of it. Shoulder straps 92 fold over such that connecting pads (not shown) connect to connecting pad 94. While this design is suitable, it is generally not preferred. It requires the addition of another connecting pad and reduces the strength of the attachment of the shoulder pad.

Figure 9:
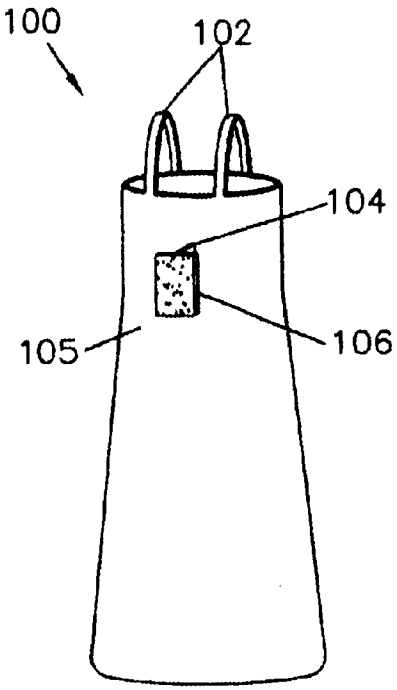
FIG. 9 is a diagrammatic rear view of an alternative embodiment of the present invention.

FIG. 9 shows an alternative embodiment as mentioned above for the pivoting device. Pivoting device 104 is comprised of a single connection panel connected to connecting pad 106 and back of pouch 100, 105. Overstraps 102 may also be seen. As described above, this adds strength to the connection of the pouch to:the mattress. However, the single connection panel design is weaker and may wear or break more readily than the two connection panel system.

Figure 9A:
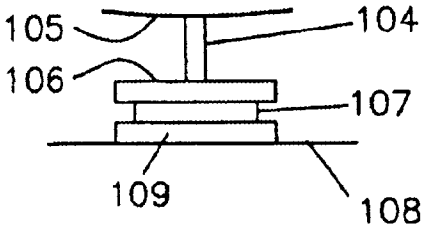
FIG. 9*a* is a diagrammatic enlarged top plan view of the embodiment of the present invention shown in FIG. 9.

FIG. 9*a* shows the single connection panel pivoting device 104 from another angle for clarity. Connection pad 106 has Velcro® pad 107 that corresponds to connecting pad 109 on mattress 111. Connection panel 104 comprises the pivoting device and attaches connecting pad 106 to the back of the pouch 105. As stated, this is generally not preferred due to lack of strength. As with other connection panels, it is necessary that panel 104 be sufficiently long to allow the child to roll from side to side and sufficiently short to prevent the child from rolling onto his or her stomach. It may be comprised of any material so long as it is sufficiently strong and sufficiently flexible.

Figure 10:
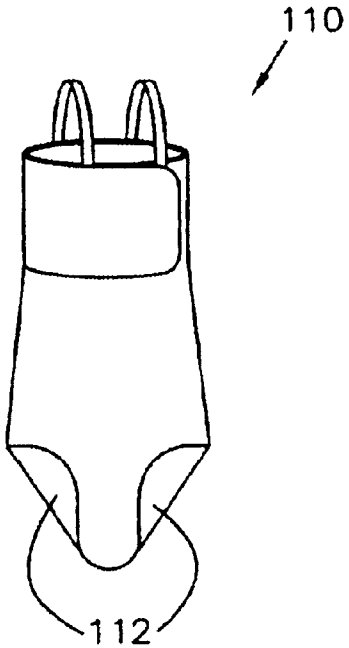
FIG. 10 is a diagrammatic front view of an alternative embodiment of the present invention.

In FIG. 10, alternative embodiment 110 can be seen. As is shown, safety pouch 110 has two holes 112 in the bottom of the connecting pouch. This allows the child's legs to protrude from the pouch 10 and move about freely. This embodiment may be preferred in especially warm climates as it provides for less covering of the child. However, modification of adding leg holes 112 is an obvious alternative embodiment.

Similarly, FIG. 11 shows an obvious alternative embodiment. Safety pouch 120 has a torso portion 122 and a leg portion 124 that are approximately the same size. While this may slightly reduce production costs due to less material required, this is generally not preferred as it restricts the movement of the child's legs.

As may be noted, safety pouches 110 and 120 shown in FIGS. 10 and 11, respectively, do not have a zipper. This is intended to show that the zipper is not a necessary feature. However, as stated above, this is generally not preferred. If a child is not ready to go to bed, he or she will often become feisty and begin rapidly flailing his or her limbs. The smaller opening in pouches 110 and 120 make it more difficult for a child with flailing limbs to be inserted into the pouch.

Whereas, the present invention has been described in relation to the drawings attached hereto, it should be understood that other and further modifications, apart from those shown or suggested herein, may be made within the spirit and scope of this invention.

What is claimed is:

1. A pouch for increasing the safety of a child comprising:

a pouch having a leg portion, a torso portion, a front and a back, wherein the leg portion is only attached to the torso portion and said leg portion is not anchored;

at least one means for securely enclosing a child within the pouch;

at least one shoulder strap adjustably attached to the pouch;

a pivoting means comprising at least one connection panel on the back of the torso portion of the pouch;

a connecting pad attached to the pivoting means and removably attachable to a corresponding connecting pad on a mattress by means of a hook and loop mechanism.

2. The pouch of claim 1 wherein the leg portion is larger than the torso portion.

3. The pouch of claim 1 wherein the at least one means for securely enclosing a child within the pouch comprises a primary flap and a secondary flap that are adjustably attachable to one another and are on the front of the pouch.

4. The pouch of claim 3 wherein the at least one means for securely enclosing a child further comprises a zipper on the front of the pouch.

5. The pouch of claim 1 wherein the at least one shoulder strap comprises two shoulder straps.

6. The pouch of claim 3 wherein the primary flap and the secondary flap are removably attachable by means of a hook and loop mechanism.

7. The pouch of claim 1 wherein the at least one shoulder strap is adjustably attached to the pouch by means of a hook and loop mechanism.

8. The pouch of claim 1 wherein the pouch is comprised of a fire resistant material.

9. The pouch of claim 1 wherein the at least one connection panel comprises two connection panels.

10. The pouch of claim 1 wherein the connecting pad on a mattress further comprises a mattress cover removably attached to a mattress.

11. The pouch of claim 1 wherein the mattress is in a crib.

* * * * *